US010147360B2

(12) United States Patent
Hack et al.

(10) Patent No.: US 10,147,360 B2
(45) Date of Patent: Dec. 4, 2018

(54) RUGGED DISPLAY DEVICE ARCHITECTURE

(71) Applicant: Universal Display Corporation, Ewing, NJ (US)

(72) Inventors: Michael Hack, Ewing, NJ (US); David Allee, Ewing, NJ (US)

(73) Assignee: Universal Display Corporation, Ewing, NJ (US)

( * ) Notice: Subject to any disclaimer, the term of this patent is extended or adjusted under 35 U.S.C. 154(b) by 0 days.

(21) Appl. No.: 14/674,448

(22) Filed: Mar. 31, 2015

(65) Prior Publication Data

US 2016/0293099 A1 Oct. 6, 2016

(51) Int. Cl.
*G09G 3/3275* (2016.01)

(52) U.S. Cl.
CPC ... *G09G 3/3275* (2013.01); *G09G 2310/0297* (2013.01)

(58) Field of Classification Search
CPC .. G06F 1/1652; G09G 3/3225; G09G 3/3275; G09G 2310/0297
See application file for complete search history.

(56) References Cited

U.S. PATENT DOCUMENTS

| | | | |
|---|---|---|---|
| 4,769,292 | A | 9/1988 | Tang et al. |
| 5,247,190 | A | 9/1993 | Friend |
| 5,703,436 | A | 12/1997 | Forrest et al. |
| 5,707,745 | A | 1/1998 | Forrest et al. |
| 5,834,893 | A | 11/1998 | Bulovic et al. |
| 5,844,363 | A | 12/1998 | Gu et al. |
| 6,013,982 | A | 1/2000 | Thompson et al. |
| 6,087,196 | A | 7/2000 | Sturm et al. |
| 6,091,195 | A | 7/2000 | Forrest et al. |
| 6,097,147 | A | 8/2000 | Baldo et al. |

(Continued)

FOREIGN PATENT DOCUMENTS

| | | |
|---|---|---|
| EP | 1238981 | 9/2002 |
| JP | 2010/135467 | 6/2010 |

(Continued)

OTHER PUBLICATIONS

Zach Honig; Samsung unveils Galaxy Gear smartwatch with 1.63-inch AMOLED touchscreen, built in camera, 70 apps; Sep. 4, 2013, http://www.engadget.com/2013/09/04/samsung-unveils-galaxy-gear.*

(Continued)

*Primary Examiner* — Mihir K Rayan
(74) *Attorney, Agent, or Firm* — Riverside Law LLP

(57) ABSTRACT

Described herein are display devices having architectures with a reduced number of external connections from the display to the external electronics, which allows for an increase in the pitch of the external connections, thereby improving reliability and flexibility, and reducing costs. The architecture of these devices is based on using multiplexers to connect external source lines to the individual display column lines. Accordingly, data signals can come into the display on a reduced number of external source lines as compared to the number of display column lines. The architecture allows for high-reliability, rugged contacts to a small-sized display by avoiding the need for high resolution interconnects.

18 Claims, 1 Drawing Sheet

(56) References Cited

U.S. PATENT DOCUMENTS 6,118,081 A * 9/2000 Faragi ..... G02F 1/13452 174/260
6,294,398 B1 9/2001 Kim et al.
6,303,238 B1 10/2001 Thompson et al.
6,333,729 B1 * 12/2001 Ha ..... G09G 3/3688 345/100
6,337,102 B1 1/2002 Forrest et al.
6,468,819 B1 10/2002 Kim et al.
7,279,704 B2 10/2007 Walters et al.
7,431,968 B1 10/2008 Shtein et al.
7,968,146 B2 6/2011 Wanger et al.
8,004,480 B2 * 8/2011 Kim ..... G09G 3/3291 345/76
2001/0052888 A1 * 12/2001 Hebiguchi ..... G09G 3/3666 345/87
2002/0113800 A1 * 8/2002 Jones ..... G09G 5/02 345/589
2003/0016590 A1 * 1/2003 Brewer ..... G02B 26/026 368/82
2003/0230980 A1 12/2003 Forrest et al.
2004/0174116 A1 9/2004 Lu et al.
2005/0007352 A1 * 1/2005 Nathan ..... G09G 3/3677 345/204
2005/0207249 A1 * 9/2005 Morita ..... G09G 3/3233 365/203
2005/0265400 A1 * 12/2005 Shin ..... G09G 3/325 370/540
2006/0107143 A1 * 5/2006 Kim ..... G09G 3/3233 714/726
2006/0123293 A1 * 6/2006 Kim ..... G09G 3/3291 714/724
2008/0062089 A1 * 3/2008 Kim ..... G09G 3/3275 345/76
2013/0026452 A1 1/2013 Kottas et al.
2013/0119354 A1 5/2013 Ma et al.
2013/0207564 A1 * 8/2013 Ota ..... H05B 37/02 315/224
2013/0207946 A1 * 8/2013 Kim ..... G09G 3/3225 345/204
2013/0257752 A1 * 10/2013 Tripathi ..... G09G 3/20 345/173
2014/0077163 A1 * 3/2014 Hack ..... G09G 3/3258 257/40
2015/0022770 A1 * 1/2015 Yamaguchi ..... G09F 9/30 349/139
2015/0185944 A1 * 7/2015 Magi ..... G06F 1/1652 345/174
2016/0055828 A1 * 2/2016 Hashimoto ..... G09G 5/18 345/212

FOREIGN PATENT DOCUMENTS

WO 2004/111066 12/2004
WO 2008/044723 4/2008
WO 2008057394 5/2008
WO 2010011390 1/2010
WO 2010/111175 9/2010

OTHER PUBLICATIONS

Vrej Barkhordarian; Power MOSFET Basics; International Rectifier, El Segundo, CA; http://www.infineon.com/dgdl/mosfet.pdf?fileId=5546d462533600a4015357444e913f4f; p. 6 and Figure 9.*
Wikipedia, "Tape-automated bonding," accessed on Nov. 18, 2015, https://en.wikipedia.org/wiki/Tape-automated_bonding.
Baldo et al., "Highly Efficient Phosphorescent Emission from Organic Electroluminescent Devices," Nature, vol. 395, 151-154, (1998).
Baldo et al., "Very high-efficiency green organic light-emitting devices based on electrophosphorescence," Appl. Phys. Lett., vol. 75, No. 1, 4-6 (1999).

* cited by examiner

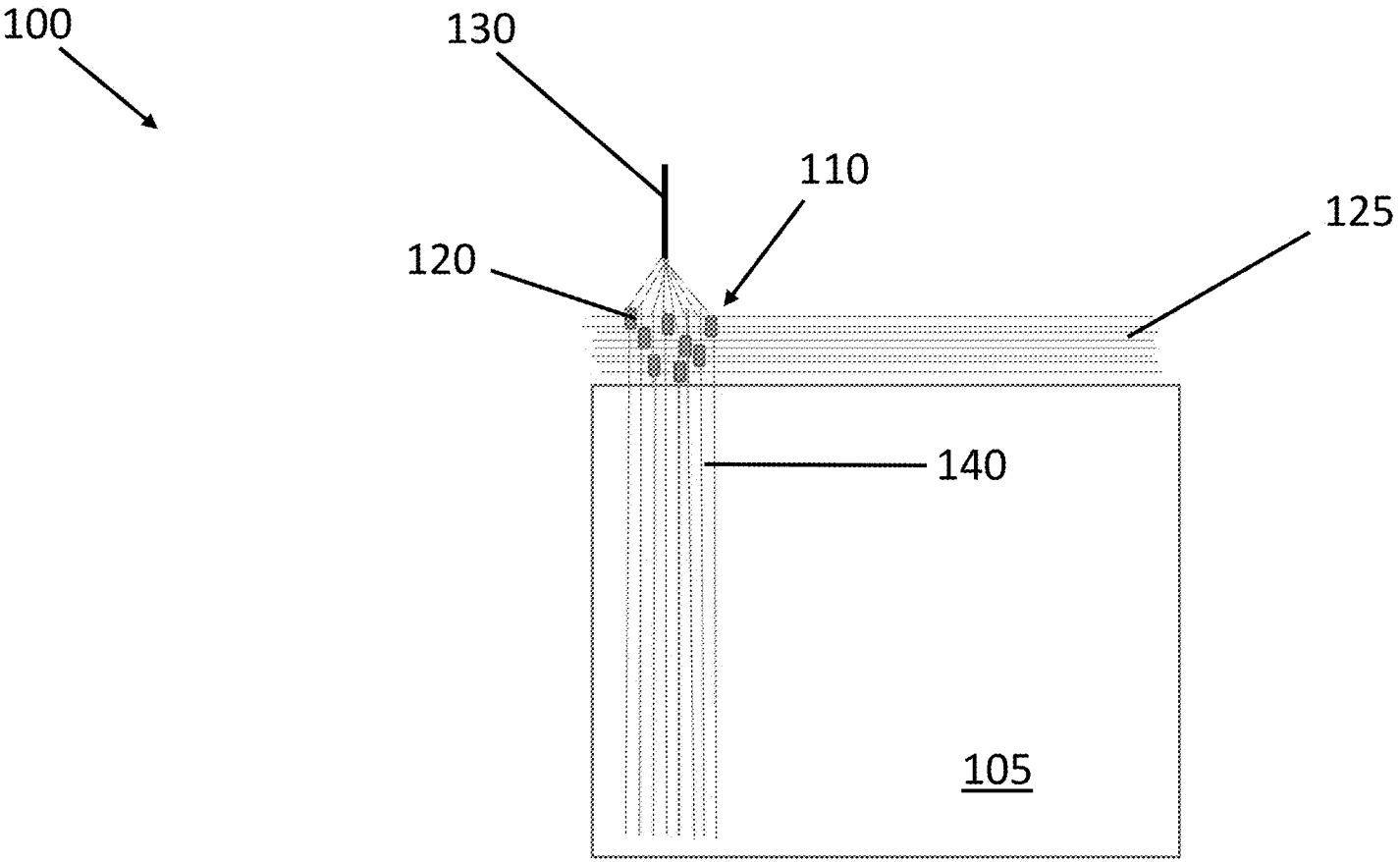
100
130
120
110
125
140
105

RUGGED DISPLAY DEVICE ARCHITECTURE

PARTIES TO A JOINT RESEARCH AGREEMENT

The claimed invention was made by, on behalf of, and/or in connection with one or more of the following parties to a joint university corporation research agreement: Regents of the University of Michigan, Princeton University, University of Southern California, and the Universal Display Corporation. The agreement was in effect on and before the date the claimed invention was made, and the claimed invention was made as a result of activities undertaken within the scope of the agreement.

FIELD OF THE INVENTION

The present invention relates to an architecture design for an organic light emitting device (OLED) display that utilizes a low number of external electronic connections.

BACKGROUND

There is an increasing demand for low-cost, flexible displays, particularly for wearable applications. Current displays use high resolution interconnects for data driving, with the driver chip or chips typically using tape automated bonding (TAB) to bond the interconnects to the display. Current TAB processes are expensive, result in low reliability when devices are flexed, and can be difficult to implement on deformable plastic substrates. For example, in a display with a 333 dpi pitch (RGB), the spacing between contacts is only 25 μm, making flexible connections unreliable. Accordingly, current devices designed for flexible or wearable applications must be constructed in an alternative and more reliable manner.

Thus, there is a continuing need in the art for a flexible, low-cost design architecture that can be used for rugged and reliable devices, such as wearable displays or other small-display applications. Described herein is a design architecture and related devices that address this continuing need in the art.

SUMMARY

According to aspects of the disclosed subject matter, architectures for displays having a reduced number external electronic interconnects, and methods for manufacturing devices utilizing these architectures, are provided. In one embodiment, the device is an OLED display device, comprising: a display element having a plurality of data lines connected to a plurality of pixel electrodes; a plurality of external source connections and control lines; and an analog multiplexer comprising a plurality of transistors; wherein the number of external source connections to the display is less than half the number of data lines on the display element. In one embodiment, the external source connections to the device are heat seal bonded. In one embodiment, the device is flexible. In one embodiment, the transistors are organic thin film transistors (TFTs). In one embodiment, the display frame rate is less than or equal to 30 Hz. In one embodiment, the connection area for all external source connections is on one edge of the display element. In one embodiment, all data and power connections to the display element are on one edge of the display element. In one embodiment, the connection area for all interconnects is on one edge of the display element. In one embodiment, the width of the connection area is less than the width of the display element. In one embodiment, the display element dimensions are less than or equal to 2"×2". In one embodiment, the device is wearable. In one embodiment, the transistors are inorganic transistors. In one such embodiment, the inorganic transistors are selected from the group consisting of: amorphous silicon, low-temperature polysilicon (LTPS), and zinc oxide. In one embodiment, the transistors have an ON resistance of less than 88 kOhms. In one embodiment, the number of gray levels is less than 32. In one embodiment, the external source connection pitch is double the pitch of the data lines in the display element. In one embodiment, the external source connection pitch is greater than or equal to 200 μm. In one embodiment, the external source connection pitch is greater than or equal to 300 μm. In one embodiment, the display element has a resolution of at least 300 dpi. In one embodiment, the display element has a plurality of pixels and each pixel comprises emissive regions having exactly two colors. In one embodiment, the display element comprises sub-pixels of at least four different colors.

In one embodiment, the method of manufacturing a high resolution OLED display device comprises: connecting a plurality of data lines to a plurality of pixel electrodes on a display element; and connecting a plurality of external source connections to the display element data lines via an analog multiplexer having a plurality of transistors; wherein the external source connection pitch is at least double the pitch of the data lines in the display element. In one embodiment, the method further comprises connecting all the plurality of external source connections to one edge of the OLED display device. In one embodiment, the OLED display device is flexible. In one embodiment, the transistors are organic thin film transistors. In one embodiment, the display frame rate is less than or equal to 30 Hz. In one embodiment, the display element dimensions are less than or equal to 2"×2". In one embodiment, the external source connections are heat seal bonded. In one embodiment, the width of the connection area is less than the width of the display element. In one embodiment, the transistors are inorganic transistors. In one such embodiment, the inorganic transistors are selected from the group consisting of: amorphous silicon, low-temperature polysilicon (LTPS), and zinc oxide. In one embodiment, the transistors have an ON resistance of less than 88 kOhms. In one embodiment, the external source connection pitch is double the pitch of the data lines in the display element. In one embodiment, the external source connection pitch is greater than or equal to 200 μm. In one embodiment, the external source connection pitch is greater than or equal to 300 μm. In one embodiment, the display element has a resolution of at least 300 dpi. In one embodiment, the display element has a plurality of pixels and each pixel comprises emissive regions having exactly two colors. In one embodiment, the display element comprises sub-pixels of at least four different colors.

BRIEF DESCRIPTION OF THE DRAWINGS

FIG. 1 is a diagram of a display with multiplexed data connections having one external source connection for 8 data lines in the display element.

DETAILED DESCRIPTION

Unless defined otherwise, all technical and scientific terms used herein have the same meaning as commonly understood by one of ordinary skill in the art to which this invention belongs. As used herein, each of the following terms has the meaning associated with it as described.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, or ±0.1% from the specified value, as such variations are appropriate.

As used herein, the terms "external connections," "external electronic connections," "interconnects," "electronic interconnects," "external interconnects," and the like are used interchangeably herein, and can refer to any connection point that can be used to connect, or otherwise provide an interface for, electronic components that are external to the display devices described.

As used herein, the terms "external source connections," "external source lines," and the like are used interchangeably herein, and refer to the subset of external connections that are or can be multiplexed with control lines.

As used herein, the term "control lines" refers to lines or connections providing power, timing signals, or any other information necessary to make a display operate correctly. As described herein, in one embodiment, control lines are needed for the operation of the gate of the multiplexing transistors connecting the data lines to the external source connections.

As used herein, the term "frame rate" refers to the rate at which new data is provided to the display to update the intensity of each pixel in the display.

As used herein, the term "address speed" refers to the rate at which the pixel luminance data (video image data) can be delivered to a display from an external source.

Throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, 6 and any whole and partial increments therebetween. This applies regardless of the breadth of the range.

Described herein are display devices having architectures with a reduced number of external connections from the display to the external electronics, which allows for an increase in the pitch of the external connections, thereby improving reliability and flexibility, and reducing costs. The architecture of these devices is based on using multiplexers to connect external source lines to the individual display column lines. Accordingly, data signals can come into the display on a reduced number of external source lines as compared to the number of display column lines. The architecture allows for high-reliability, rugged contacts to a small-sized display by avoiding the need for high resolution interconnects. Thus, the architecture is useful for flexible display devices, such as wearable OLED displays. In addition to providing lower-cost small-display devices, the interconnect contacts in devices using this architecture can maintain their integrity longer than the external connection contacts in other devices.

The architecture described herein is particularly advantageous for small displays where the address speed can be much higher than the required frame rate. The architecture described herein is based on the understanding that displays of a size useful for wearable applications or other small display applications, for example displays having display elements about 1 to 2 inches in size, or even up to about 3" in size, will have a relatively small number of row lines. While the small number of row lines allows for relatively high frame rates due to the low display capacitances and low number of scan lines, the frame rate performance requirements of many small display applications may be much lower than other display applications. Therefore, the refresh rates for small displays can be relatively low, for example 15 Hz or 30 Hz, yet these displays can still exhibit acceptable performance to the user.

The difference between the highest address speed (X) and required refresh rate (Y) can be used to multiplex data into the display, for example reducing the number of external connections by an approximate factor of X/Y. The reduction of the number of connections allows the pitch between interconnects to be increased. Therefore, instead of using TAB processes to make the interconnect contacts, as currently used for most small display devices, a simpler, more reliable, and cheaper heat seal process can be used to make the interconnects. However, even if TAB processes or other bonding processes are used, the architecture described herein can still result in improved small display devices because the architecture allows for larger interconnect contacts and/or increased separation between the contacts which can improve the structural stability of the interconnects. Accordingly, small displays having the architecture described herein can be used reliably for flexible or "rollable" displays requiring rugged interconnects.

Referring now to FIG. 1, a diagram of one embodiment of device 100 is shown generally having a display element 105 and a multiplexer 110. As would be understood by a person skilled in the art, device 100 can include any other components necessary or desirable for display devices, for example but not limited to a scan driver or any other type of driver, processors, memory, controllers, and software or any other type of logic. Multiplexer 110 includes a plurality of transistors 120, for example organic thin film transistors (TFTs). A plurality of control lines 125 are connected to the gates of transistors 120. Further, each transistor 120 has its drain connected to a data line 140, with each data line 140 connected to a pixel electrode (not shown). The source connections of transistors 120 are connected to the external source connections 130. In the example of device 100 shown, there is one external source connection 130 for eight data lines 140. However, in other embodiments of device 100, there can be a plurality of external source connections and control lines which are suitably configured to provide the desired number of data lines, which further correspond to the desired number of display columns and pixels. It is contemplated herein that drain and source connections for the multiplexing TFTs can be interchangeable.

For example, in one embodiment, device 100 can be included in a 1"×1" wearable OLED display. Such a device can have 324×324 pixels with 3 sub-pixels for color in an active matrix architecture, resulting in 972 data lines (140) and the frame rate can be 30 Hz or lower while having acceptable performance for the user. In such an embodiment, device 100 can have twenty-seven external source connections (130) multiplexed with thirty-six control lines (125) via 972 transistors (120). The 972 transistors (120) are in turn are each connected to one of the 972 data lines (140). Accordingly, in such an embodiment, the total number of interconnects from the display to the external electronics, i.e., the total number of external source connections and control lines is sixty-three, which can be used to drive a 972 column display element (3×324 pixels). Further, in such an embodiment, the number of external source connections (twenty-seven) is significantly less than the number of data lines on the display element.

In such an embodiment, multiplexer 110 can be built on the display with transistors, preferably TFTs, multiplexing a reduced number of external source connections across the 972 source or column lines within one row time. In one embodiment, multiplexer 110 is an analog multiplexer which can effectively be just a single transistor or TFT, often referred to as a pass transistor. External control signals switch on and off a set of source connections in sequence by applying a gate voltage to the TFT pass transistors. Using the architecture described herein, no TFT logic is needed, thereby avoiding the substantial power dissipation associated with integrated digital drivers. Also, there is no restriction on the number of gray levels with this approach. For example, in one embodiment, the number of gray levels in device 100 is less than or equal to 32. In another embodiment, the number of gray levels can be less than or equal to 8. However, the number of gray levels is not limited to any specific embodiment described herein.

As contemplated herein, external silicon ICs provide the source voltages to be multiplexed. Accordingly, whatever analog voltage levels are provided to the display can be multiplexed by the TFTs to the appropriate column or source lines. This approach can reduce the total number of connections sufficiently to be able to implement low cost, low resolution heat seal bonding instead of expensive, high resolution TAB processes. High resolution TAB processes are a particular challenge for flexible displays since the thermal coefficient of expansion of the flexible display substrate rarely matches the TAB bond. Using a TAB process, the extremely fine pitch necessary for 972 connections in 1" would require the spacing of the TAB bond and the display to match at the temperature of bonding, which would be highly unreliable and can be altogether avoided using the architecture described herein. Accordingly, instead of a TAB process, heat seal bonding can be used.

Further, by reducing the number of total external connections, i.e., external source connections and control lines, the pitch of the connections can be increased. In one embodiment, the external connection pitch is greater than or equal to 200 μm. In other embodiment, the external connection pitch is greater than or equal to 300 μm. However, the external connection pitch is not limited to any specific embodiment described herein and can be less than 200 μm. In addition, by reducing the number of external connections and/or increasing the connection pitch, the size and location of the connection area for the external source connections or any other interconnect of device 100 can modified and optimized. For example, in one embodiment, all external source connections 130 on device 100, regardless of the size of display element 105, can be along a single edge of display element 105. In another embodiment, all interconnects, including external source connections 130 and control lines 125 can be along a single edge of display element 105. Having the external source connections or interconnects on a single edge is desirable for flexible displays that may be rolled up or otherwise used such that only a single edge is readily accessible. In various embodiments, device 100 can include other types of external connections apart from the source connections and control lines, for example power and timing signals for a shift register and other functions.

As described herein, in one embodiment, device (100) has 972 display data lines (140) for a 1 inch display element (105). In one embodiment, display element (105) having a 1 inch edge can allow a maximum of about 84 connections or interconnects with heat seal tape, assuming a 300 μm external interconnect pitch. As the number of external source connections (130) is decreased, the number of control lines (125) for the multiplexer (110) must be increased, and the faster the multiplexer must be switched, to fill all 972 display data lines (140) in one row time. For example, 486 external source connections (130) could be multiplexed with 2 control lines (125) to fill 2 banks of source lines. The total number of interconnects in such an embodiment is 486 plus 2 or 488. In another embodiment of a display with 972 data lines (140), 243 external source connections (140) could be multiplexed with 4 control lines (125) to fill 4 banks of source lines for a total number of interconnects of 247. For a device (100) with less than 84 total potential interconnects on one edge of display element (105), 27 external source connections (130) and 36 control lines (125) can be used to fill 36 banks of source lines in one row time. Accordingly, the total number of interconnects in such an embodiment of device (100) would be only 63, enabling the use of low cost, heat seal tape for the interconnects.

However, the number of external source connections and control lines are not limited to the specific embodiments described herein, and the numbers of external source connections and control lines, and the ratio of the numbers thereof, can be modified to account for any sized display element, any desired number of external interconnects, and/or any desired number of display data lines, as would be understood by a person skilled in the art. In one embodiment, for example as described above for a device having a 1 inch display element with 972 data lines, the number of external source connections (27) is significantly less than the number of data lines, i.e., less than about 3%. In another embodiment, the number of external source connections can be less than or equal to half the number of data lines, for example 486 external source connections for 972 data lines, as described in one embodiment above. In yet another embodiment, the number of external source connections can be less than or equal to 25% of the number of data lines, for example 243 external source connections for 972 data lines, as described in one embodiment above.

The size or characteristics of the transistors used in the devices described herein can be selected as necessary to suitably operate within the display characteristics, as would be understood by a person skilled in the art. One row time for 324 rows and a 30 Hz frame rate is about 103 μs. So each bank can be filled in 1/36 of the row time or about 2.86 μs. The transistors in multiplexer 110 may be sized to be able to drive the source line capacitance in the 2.86 μs available. The column or source line capacitance has been estimated to be 26 pF with 10 μm lithography, but 5 μm lithography can be used due to the small size of the sub-pixel as described above. This will reduce the TFT pixel access transistor capacitance by 4 times and the source line capacitance becomes ~6.5 pF. Assuming 5 time constants for adequate settling, the TFTs in the multiplexer must have an on resistance less than 88 kOhms. An organic TFT with 3 $cm^2/Vs$ mobility and $200\times10^{-6}$ $F/m^2$ gate capacitance, a −2 V threshold voltage and a 10 V drive will have an ON resistance of 87 kOhms for a device 120 μm wide and 5 μm gate length. This is a practical size for a TFT, and another factor of two increase in width is reasonable as well, as would be understood by a person skilled in the art.

In one embodiment, there can be some additional power consumption in the analog TFT multiplexer. For example, in the embodiment with a total of 972 TFTs in the multiplexer, each TFT can have a gate length of 5 μm and a gate width of 120 μm. The gate capacitance of each TFT can be 240 fF, allowing for some overlap capacitance. All 972 TFTs must switch between 10 V and ground in each row time or at a rate of 324×30 Hz. The total power required by the analog multiplexer is a reasonable 227 μW, much below the power of the display itself. Even if additional routing capacitance is included for the multiplexer, the total multiplexer power is likely no more than 1 mW, which is an acceptable value as would be understood by a person skilled in the art.

In one embodiment, transistors 120 in multiplexer 110 can be any suitable transistor. For example, in one embodiment, the transistors can be TFTs, preferably organic TFTs. However, the TFTs can also be inorganic TFTs, for example, but not limited to amorphous silicon, low-temperature polysilicon (LTPS), and zinc oxide TFTs, or TFTs based on the oxide compounds of metals other than zinc. Transistors other than TFTs can also be used for multiplexer 110, as would be understood by a person skilled in the art.

The present invention also relates to methods for manufacturing a display device according to the architecture described herein. For example, in one embodiment the method can include the steps of connecting a plurality of data lines to a plurality of pixel electrodes on a display element; and connecting a plurality of external source connections to the display element data lines via a multiplexer having a plurality of transistors; wherein the external source connection pitch is at least double the pitch of the data lines in the display element. In other embodiments, the external source connection pitch can be more or less than double the pitch of the data lines in the display element, as would be understood by a person skilled in the art in consideration of the embodiments of devices described herein. Further, the methods can include any other step suitable for manufacturing a display device, such as a small, flexible, OLED display device, or a high resolution display device.

As would be understood by a person skilled in the art, the descriptions herein have been simplified to illustrate elements that are relevant for a clear understanding of the present invention, while eliminating, for the purpose of clarity, many other elements found in the art related to displays, especially OLED displays, and other electronics or components that can be included with such displays. Accordingly, it is understood that the various embodiments described herein are by way of example only, and are not intended to limit the scope of the invention. For example, many of the materials and structures described herein may be substituted with other materials and structures without deviating from the spirit of the invention. The present invention as claimed may therefore include variations from the particular examples and preferred embodiments described herein, as will be apparent to one of skill in the art. It is understood that various theories as to why the invention works are not intended to be limiting.

The invention claimed is:

1. An OLED display device, comprising:

a flexible display element having:

a plurality of data lines connected to a plurality of pixel electrodes;

a plurality of external source connections and control lines; and an analog multiplexer comprising a plurality of transistors positioned internal to the flexible display element; and a digital data driver positioned external to the flexible display element, connected to the analog multiplexer via the plurality of external source connections and control lines;

wherein the display element dimensions are less than or equal to 2"×2";

wherein the data lines directly connect the plurality of pixel electrodes to the analog multiplexer; and wherein the number of external source connections to the display is less than one quarter the number of data lines on the display element.

2. The device of claim 1, wherein the external source connections to the device are heat seal bonded.

3. The device of claim 1, wherein the transistors are organic thin film transistors.

4. The device of claim 1, wherein a display frame rate is less than or equal to 30 Hz.

5. The device of claim 1, wherein a connection area for all external source connections is on one edge of the display element.

6. The device of claim 5, wherein the width of the connection area is less than the width of the display element.

7. The device of claim 1, wherein a connection area for all interconnects is on one edge of the display element.

8. The device of claim 1, wherein the transistors have an ON resistance of less than 88 kOhms.

9. The device of claim 1, wherein the external source connection pitch is double the pitch of the data lines in the display element.

10. The device of claim 1, wherein the external source connection pitch is greater than or equal to 200 μm.

11. The device of claim 1, wherein the display element has a resolution of at least 300 dpi.

12. The device of claim 1, wherein the display element has a plurality of pixels and each pixel comprises emissive regions having exactly two colors.

13. The device of claim 1, comprising no more than one digital data driver.

14. A method of manufacturing a high resolution OLED display device, comprising:

connecting a plurality of data lines to a plurality of pixel electrodes on a flexible display element;

connecting a plurality of external source connections to the display element data lines via an analog multiplexer internal to the flexible display element and having a plurality of transistors; and connecting the plurality of external source connections to a digital data driver external to the flexible display element;

wherein the display element dimensions are less than or equal to 2"×2";

wherein the data lines directly connect the plurality of pixel electrodes to the analog multiplexer;

wherein the external source connection pitch is at least double the pitch of the data lines in the display element; and wherein the number of external source connections to the display is less than one quarter the number of data lines on the display element.

15. The method of claim 14, further comprising connecting all the plurality of external source connections to one edge of the OLED display device.

16. The method of claim 14, wherein the external source connections are heat seal bonded.

17. The method of claim 14, wherein the external source connection pitch is double the pitch of the data lines in the display element.

18. The method of claim 14, comprising no more than one digital data driver.

* * * * *